US007690223B2

(12) United States Patent
Abe

(10) Patent No.: US 7,690,223 B2
(45) Date of Patent: Apr. 6, 2010

(54) PART FOR CIRCULAR KNITTING MACHINE

(75) Inventor: Atsumu Abe, Wakayama (JP)

(73) Assignee: Fukuhara Needle Co., Ltd., Wakayama (JP)

( * ) Notice: Subject to any disclaimer, the term of this patent is extended or adjusted under 35 U.S.C. 154(b) by 414 days.

(21) Appl. No.: 11/720,949

(22) PCT Filed: Nov. 22, 2005

(86) PCT No.: PCT/JP2005/021431

§ 371 (c)(1),
(2), (4) Date: Jun. 6, 2007

(87) PCT Pub. No.: WO2006/061989

PCT Pub. Date: Jun. 15, 2006

(65) Prior Publication Data

US 2009/0229310 A1 Sep. 17, 2009

(30) Foreign Application Priority Data

Dec. 7, 2004 (JP) ..... 2004-354087

(51) Int. Cl.
*D04B 35/02* (2006.01)

(52) U.S. Cl. ..... 66/123; 66/116

(58) Field of Classification Search ..... 66/116, 66/119, 121, 107, 123
See application file for complete search history.

(56) References Cited

U.S. PATENT DOCUMENTS 3,464,237 A * 9/1969 Kohorn ..... 66/121
3,875,767 A * 4/1975 Kopal et al. ..... 66/123
3,990,269 A 11/1976 Kopal et al.
4,068,500 A * 1/1978 Kohorn ..... 66/123
4,237,705 A * 12/1980 Petrov ..... 66/123

(Continued)

FOREIGN PATENT DOCUMENTS

JP 61-239066 10/1986

(Continued)

OTHER PUBLICATIONS

International Search Report for PCT Application No. PCT/JP2005/021431; Filed Nov. 22, 2005; Date of Completion Jan. 20, 2006; Date of Mailing Jan. 31, 2006.

*Primary Examiner*—Danny Worrell
(74) *Attorney, Agent, or Firm*—Alston & Bird LLP

(57) ABSTRACT

To reduce the drive power consumption of a circular knitting machine by reducing the contact area of a tool for the knitting machine with the side faces of a thin groove to suppress a rise in temperature and the thermal deformation of the knitting machine by frictional heat.

A part of the stem (17) of the tool for the circular knitting machine is raised from the bottom face (20) of the thin groove (19) in which the tool for the circular knitting machine is inserted and, at the same time, sunk from the upper end face (21) of the thin groove to form float parts (22, 22A to 22L) extending parallel with the thin groove (19). When a distance (L) between the bottom face and the upper end face of the thin groove (19) is used as a reference, the float part is so formed that its raised length (L1) is 10 to 40% of (L) and its sunk length (L2) is 10 to 40% of (L).

20 Claims, 6 Drawing Sheets

U.S. PATENT DOCUMENTS

| | | | | | |
|---|---|---|---|---|---|
| 4,452,053 | A | | 6/1984 | Egbers et al. | |
| 4,470,274 | A | | 9/1984 | Shima et al. | |
| 4,625,527 | A | | 12/1986 | Fukuhara | |
| 4,681,150 | A | * | 7/1987 | Fukuhara | 66/123 |
| 5,154,069 | A | | 10/1992 | Speetjens et al. | |
| 5,231,855 | A | * | 8/1993 | Seta et al. | 66/123 |
| 5,901,582 | A | | 5/1999 | Hennig et al. | |
| 6,122,938 | A | | 9/2000 | Henning et al. | |
| 6,298,692 | B1 | * | 10/2001 | Kuroda et al. | 66/123 |
| 6,860,121 | B2 | * | 3/2005 | Jurgens et al. | 66/123 |

FOREIGN PATENT DOCUMENTS

| | | |
|---|---|---|
| JP | 62-25776 | 6/1987 |
| JP | 2989708 | 12/1999 |
| JP | 3076014 | 8/2000 |
| JP | 3231648 | 11/2001 |

* cited by examiner

PART FOR CIRCULAR KNITTING MACHINE

TECHNICAL FIELD

The present invention relates to a tool for a circular knitting machine. Such tool for a circular knitting machine could be a knitting needle (latch needle, composite needle), sinker or jack.

BACKGROUND TECHNIQUE

Circular knitting machines have traditionally used a tool having a stem (needle shank) whose lower surface touches the bottom of a thin groove into which the tool is inserted or whose upper face is at approximately the same height as the upper end face of the thin groove into which the tool is inserted.

When a circular knitting machine using such tool is operated continuously at high speed, the tool and the side faces of the thin groove come into contact with each other, generating frictional heat. To explain this point in detail, we will take a latch needle as an example of the tool used in a circular knitting machine. As shown in FIG. 2, a latch needle 10 is inserted into a thin groove 19 of the cylinder of the circular knitting machine. It rotates at high speed while sliding up and down. As the cylinder rotates, the latch needle 10 tends to tilt in the direction opposite to the rotating direction because of the inertia of movement. At this time, as indicated by an oval A in FIG. 2(*b*), the latch needle 10 and the thin groove 19 come into contact with each other at the upper end 21, and as indicated by an oval B in FIG. 2(*b*) and FIG. 2(*c*), the latch needle 10 and the thin groove 19 come into contact with each other at the lower end 20 of the thin groove, generating frictional heat. This significantly raises the temperature of the circular knitting machine, leading to thermal expansion of the circular knitting machine. This causes the following problems.

(1) The circular knitting machine can seize up if the gears of the gearing that drives the circular knitting machine are assembled with no play between each gear.

(2) The yarn-feeding tension of the knitting yarn supplied to the circular knitting machine can vary, resulting in different loop shapes of the knit fabric between immediately after the machine has started and after the machine has run for a long time.

(3) In a super large circular knitting machine such as those having a diameter of 60 inches, the diameter of the cylinder increases because of the heat expansion, narrowing the gap between the cylinder and the cam holder. This necessitates the gap between the cylinder and the cam holder to be designed with an extra margin.

FIG. 2 used in the above explanation is a cross section diagram illustrating a latch needle of the present invention. With respect to the cross section of the butt, the present invention has the same defect as prior art.

In order to solve this problem, a knitting needle for a knitting machine, disclosed in Patent Document 1 listed below, has an elongate groove extending longitudinally along at least one of the broad sides of a needle shank, thereby reducing the area that comes in contact with the side faces of the needle groove.

A knitting needle for a knitting machine, disclosed in Patent Document 2 listed below, has a concavity on at least one of the broad sides of the needle stem, thereby reducing the area that comes in contact with the side faces of the needle groove.

A knitting needle for a knitting machine, disclosed in Patent Document 3 listed below, also has a concavity on at least one of the broad sides of the needle stem, thereby reducing the area that comes in contact with the side faces of the needle groove.

A knitting needle for a knitting machine, disclosed in Patent Document 4 listed below, has a cutout on the side of the needle stem, thereby giving it a shape that meanders along its thickness.

A knitting needle for a knitting machine, disclosed in Patent Document 5 listed below, has a shock-absorbing tool made of a curved spring at the position adjacent to the butt.

A knitting needle for a knitting machine, disclosed in Patent Document 6 listed below, has a concave groove for engaging a stitch-supply-side raising cam on the stem.

Patent Document 1: U.S. Pat. No. 4,625,527

Patent Document 2: U.S. Pat. No. 6,122,938

Patent Document 3: JP-B-3231648

Patent Document 4: JP-U-60-127387

Patent Document 5: U.S. Pat. No. 5,154,069

Patent Document 6: JP-A-59-1750

DISCLOSURE OF THE INVENTION

Problems to be Solved by the Invention

In order to manufacture the knitting needles described in Patent Documents 1-4 above, special machining processes need to be applied such as cutting or pressing the side faces.

Although Patent Documents 5 and 6 above are not related to the problem of frictional heat, they are quoted here because their configurations are similar to the present invention. The curved spring described in Patent Document 5 above is provided for the purpose of absorbing shocks; it is not clear at all how effective it is with regard to frictional heat. The invention disclosed in Patent Document 6 has a concave groove on the stem based on the structure specific to the flat knitting machine. The purpose of this groove is to mesh with a cam; therefore the groove is not necessary in a circular knitting machine. While a circular knitting machine runs continuously in one direction, a flat knitting machine runs reciprocally; therefore the actual average speed is significantly slower in a flat knitting machine. In a flat knitting machine, needles also move reciprocally, constantly switching between left and right and dissipating heat as they switch positions. In other words, the problem of frictional heat is not as serious as in the case of a circular knitting machine. Because of this reason, it is difficult even for those skilled in the art to apply the structure described in Patent Document 6 as is to a tool for a circular knitting machine.

Means to Solve the Problem

The tool for a circular knitting machine of the present invention has a stem and at least one butt wherein some portions of the stem are floated from the bottom face of a thin groove into which the tool is inserted and at the same time sunk from the upper end face of the thin groove, forming floating sections that extend parallel to the thin groove in such a way that the floating sections are floated from the bottom face of the thin groove for a length ("floating length L1") that is 10-40% of the distance ("L") from the bottom face to the upper end face of the thin groove, and sunk from the upper end face of the thin groove for a length ("sinking length L2") that is 10-40% of L.

EFFECTS OF THE INVENTION

The floating sections of the tool for a circular knitting machine of the present invention do not come into contact with either the left or right wall of the thin groove even when the tool tilts to the left or right within the thin groove, generating no frictional heat at the floating sections of the stem. As described later in the results of an effect-confirming experiment, using the tool for a circular knitting machine of the present invention significantly reduces the rise in the temperature of the knitting machine when the knitting machine is run continuously at high speed, compared with using a conventional tool.

BEST MODE FOR CARRYING OUT THE PRESENT INVENTION

The present invention can be used in any tool for a circular knitting machine that has a butt, such as, as described at the beginning of this document, a knitting needle (latch needle, compound needle), sinker or jack. It is preferably used as a latch needle for a circular knitting machine, and most preferably as a meander needle having a bridge. Many of these needles are made by stamping a sheet material.

Preferably, the floating length L1 of the floating section is 20-30% of L, and the sinking length L2 of the floating section is 20-30% of L. The longitudinal length ("L4") of the floating section is preferably 10-60% of the overall length of the tool for a circular knitting machine.

It is possible to provide several floating sections that extend horizontally. In this case, it is possible to increase the strength by providing between such floating sections a support that reaches the upper and lower ends of the thin groove. It is also possible to differentiate the height of each floating section.

It is also possible to provide a cutout in each floating section to reduce weight.

BRIEF DESCRIPTION OF THE DRAWINGS

Embodiments of the present invention will now be described on the basis of the accompanying drawings, in which.

EMBODIMENT 1

Figure 1:
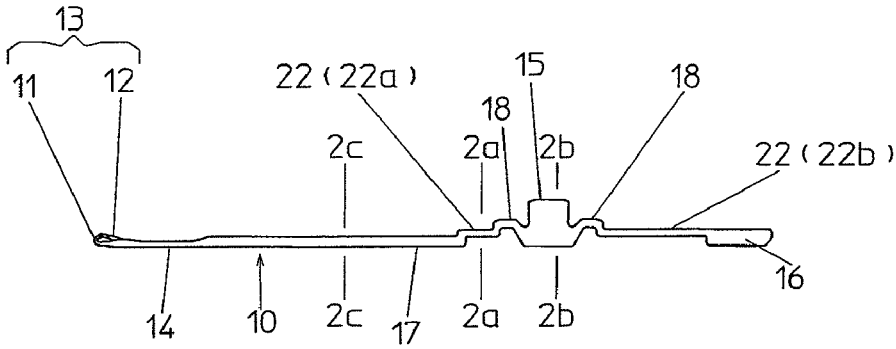
FIG. 1 is an elevation of a latch needle 10 according to a first embodiment of the present invention.

FIG. 1 is an elevation of a latch needle according to the first embodiment of the present invention.

Like conventional latch needles, the latch needle 10 of the present invention comprises, as basic components, a needle head 13 having a hook 11 and a latch 12, a needle neck 14 that follows the needle head 13, at least one butt 15, and a needle end 16. The narrow section in the middle excluding the needle head 13, needle neck 14 and needle end 16 is called a stem (or a needle shank) 17.

The latch needle 10 according to this embodiment is a so-called "meander needle", in which a horizontal bridge 18 that is higher than the level of the needle neck 14 is established between the needle head and the butt 15, and another horizontal bridge 18 is established between the needle end 16 and the butt 15. In latch needles that are longer than this example, more bridges (for example, three to six bridges) are commonly established. This kind of needle is made by stamping a sheet material.

One characteristic of the present invention is that some portions of the stem 17 are floated from the bottom face 20 of the thin groove (19 in FIG. 2) into which the latch needle is inserted while at the same time sunk from the upper end face 21 of the thin groove 19, thereby forming floating sections 22. In other words, the floating sections 22 extend horizontally at a middle height that is lower than the bridge 18 and higher than the lowest part 17 of the stem. It is obvious in this embodiment that a floating section (22*a*) is established forward of the butt and another floating section (22*b*) is established backward of the butt. The number of floating sections is not limited to two. It is possible to provide three or more floating sections. Between the floating sections are the lowest part 17 of the stem (which includes the lowest part of the butt).

Figure 2:
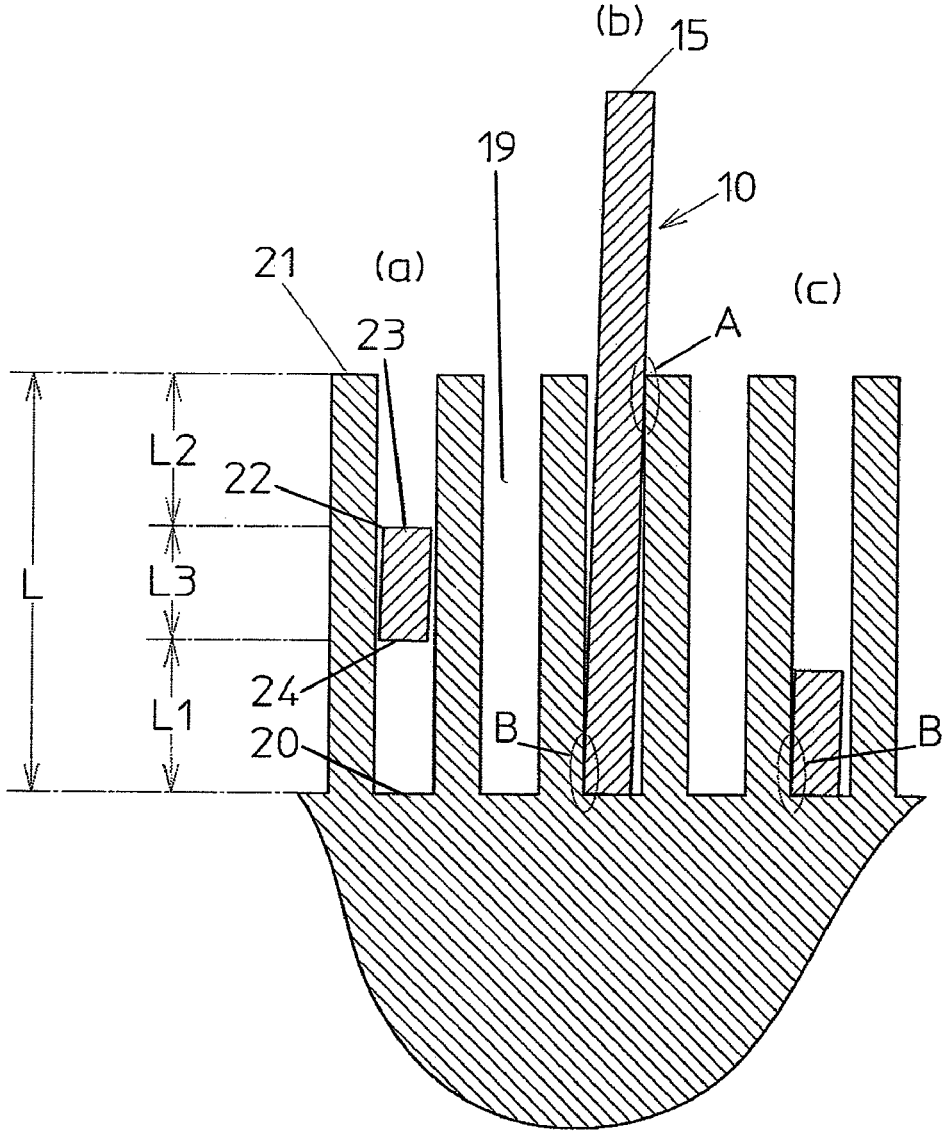
FIG. 2 is a set of cross section views of the latch needle 10 according to the first embodiment of the present invention, in which (*a*), (*b*) and (*c*) show cross sections along lines 2*a*, 2*b* and 2*c* of FIG. 1.

FIG. 2 illustrates cross section views of the latch needle 10 in use. In this drawing, with reference to the distance L from the bottom face 20 to the upper end face 21 of the thin groove 19 into which the latch needle 10 is inserted, the floating length L1 of the floating section is 10-40% (preferably 20-30%) of L, and the sinking length L2 of the floating section is 10-40% (preferably 20-30%) of L. Therefore, the vertical length L3 of the floating section is 20-80% (preferably 40-60%) of L. If the vertical length L3 of the floating section is 20% or shorter of L, the needle tends to lack strength; if it exceeds 80%, the floating effect becomes weaker.

The longitudinal length L4 of the floating section (see FIG. 3) according to the present invention is currently considered appropriate if it is 10-60% of the overall length of the latch needle. In an embodiment having several floating sections, such as this embodiment having 22Aa and 22Ab, the longitudinal length of the floating section refers to a combined length of such floating sections. If the longitudinal length of the floating section exceeds 60% of the overall length of the latch needle, the needle tends to lack strength; if it is shorter than 10%, the floating effect becomes weaker.

As shown in FIG. 2(*a*), the floating section 22 does not come into contact with the thin groove 19 at either the upper end 23 or the lower end 24 regardless of whether the needle tilts to the left or right. Therefore, no frictional heat is generated at least at that section. As shown in FIG. 2(*b*) and (*c*), the butt 15 and other non-floating sections do come in contact with the thin groove 19 even in the present invention, so the generation of frictional heat is unavoidable at these sections.

EMBODIMENT 2

Figure 3:
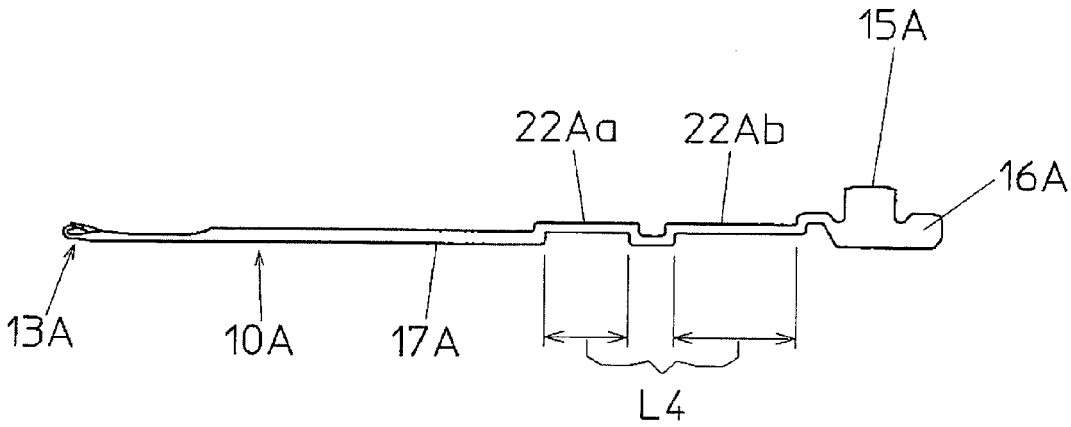
FIG. 3 is an elevation of a latch needle 10A according to a second embodiment of the present invention.

FIG. 3 is an elevation of a latch needle 10A according to the second embodiment of the present invention. This needle is different from the first embodiment in the following respect: two floating sections 22Aa and 22Ab are established only in the region forward of the butt 15A. The second embodiment is the same as the first embodiment in other respects. So further explanation is omitted, and instead, a letter "A" is added to the numerals used in the explanation of the first embodiment.

EMBODIMENT 3

Figure 4:
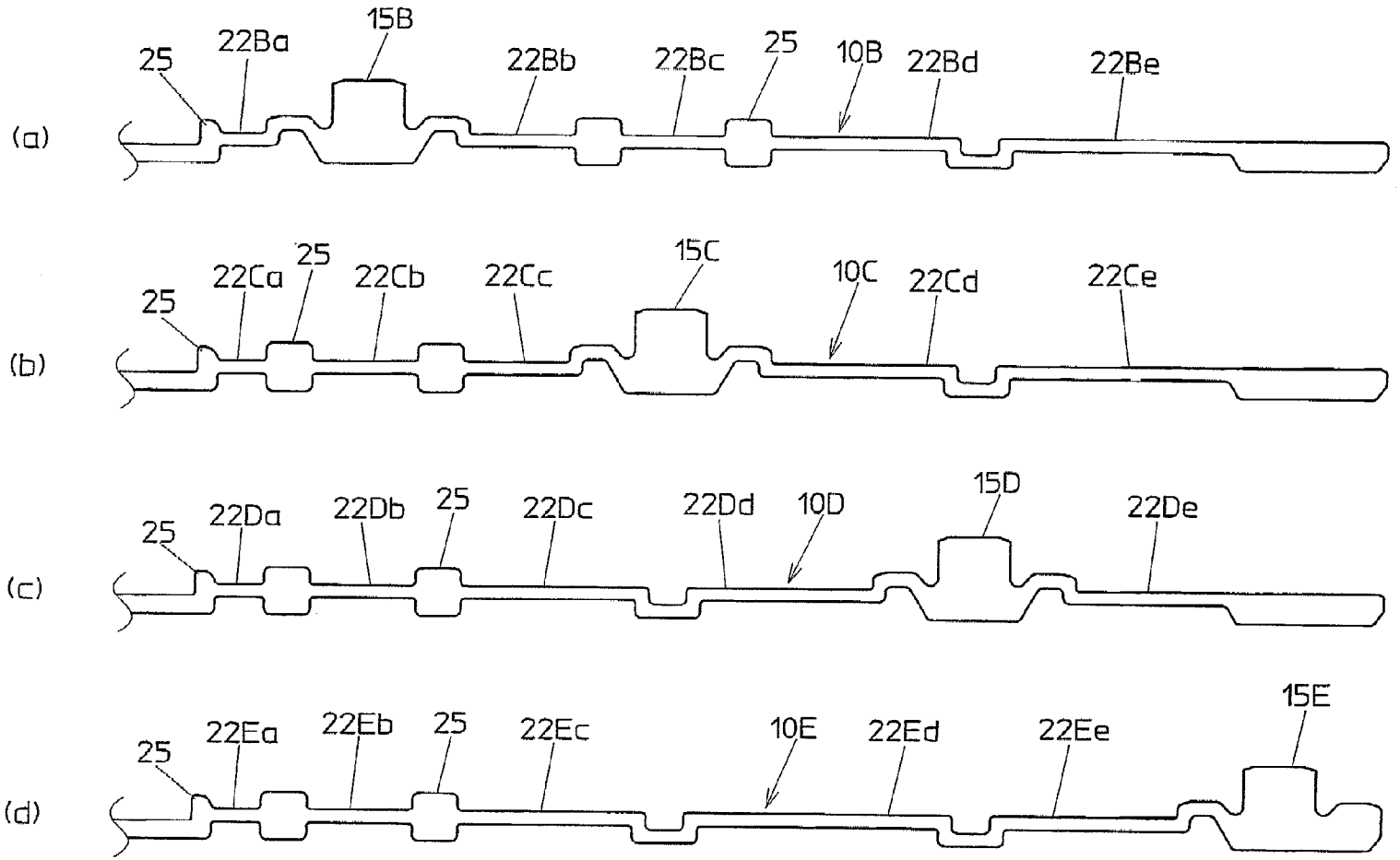
FIGS. 4(*a*), (*b*), (*c*) and (*d*) are elevations of latch needles 10B, 10C, 10D and 10E according to a third embodiment of the present invention.

FIGS. 4(*a*), (*b*), (*c*) and (*d*) are elevations of latch needles 10B, 10C, 10D and 10E according to the third embodiment of the present invention. In this drawing the tips of the needles are omitted. These are examples of latch needles provided with three or more floating sections 22.

In (a), a floating section (22Ba) is established forward of the butt, and four floating sections (22Bb, 22Bc, 22Bd, 22Be) are established backward of the butt. In (b), three floating sections (22Ca, 22Cb, 22Cc) are established forward of the butt, and two floating sections (22Cd, 22Ce) are established backward of the butt. In (c), four floating sections (22Da, 22Db, 22Dc, 22Dd) are established forward of the butt, and one floating section (22De) is established backward of the butt. In (d), five floating sections (22Ea, 22Eb, 22Ec, 22Ed, 22Ee) are established forward of the butt, with no floating sections in the backward section.

As opposed to the first and second embodiments, supports 25 that reach the upper and lower ends of the thin groove are established between each floating section 22.

EMBODIMENT 4

Figure 5:
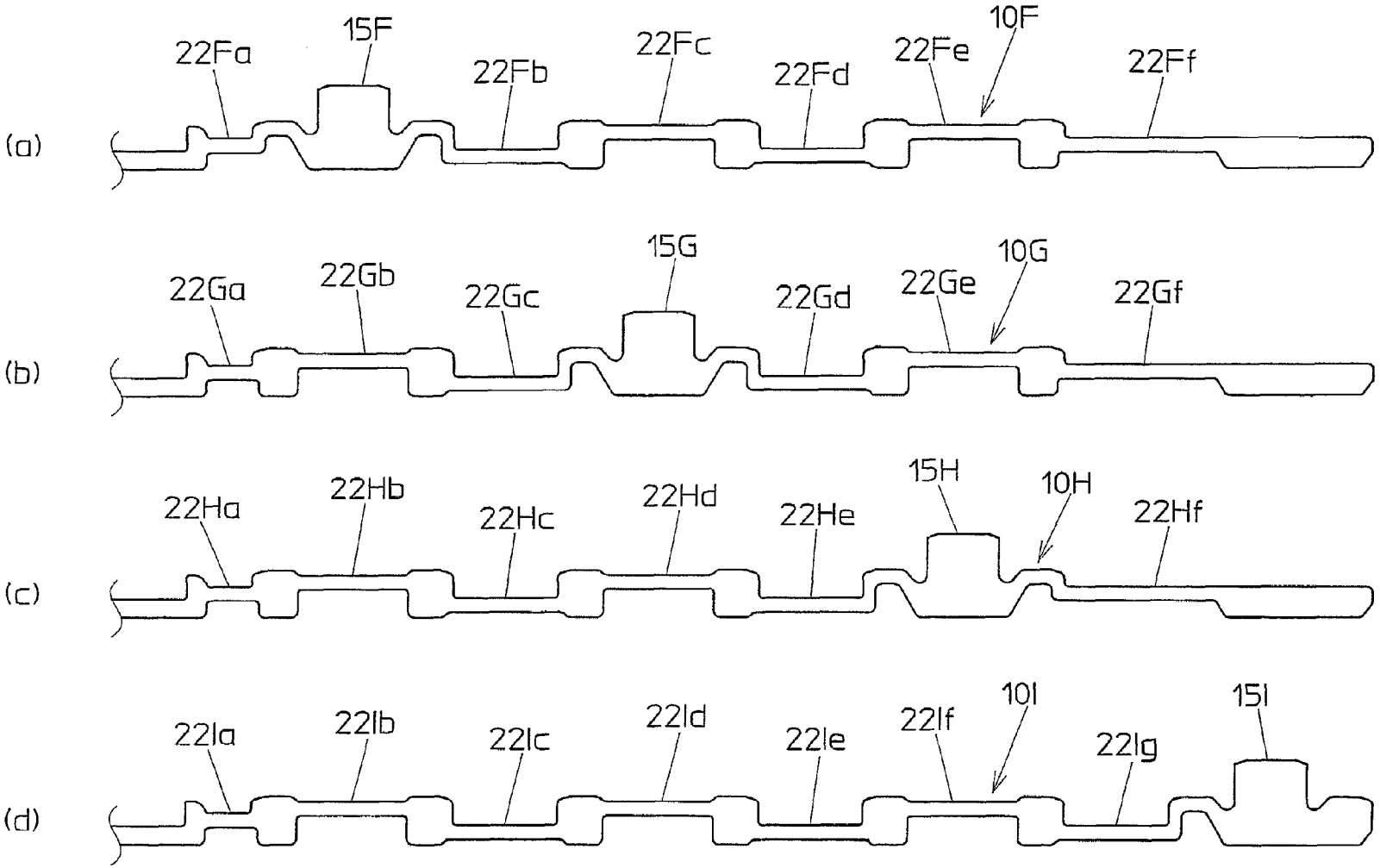
FIGS. 5(*a*), (*b*), (*c*) and (*d*) are elevations of latch needles 10F, 10G 10H and 10I according to a fourth embodiment of the present invention.

FIGS. 5(*a*), (*b*), (*c*) and (*d*) are elevations of latch needles 10F, 10G 10H and 10I according to the fourth embodiment of the present invention. In this drawing the tips of the needles are omitted. These are examples of latch needles provided with three or more floating sections 22 having different heights.

In (a), a floating section (22Fa) is established forward of the butt, and five floating sections (22Fb, 22Fc, 22Fd, 22Fe, 22Ff) are established backward of the butt. In (b), three floating sections (22Ga, 22Gb, 22Gc) are established forward of the butt, and three floating sections (22Gd, 22Ge, 22Gf) are established backward of the butt.

In (c), five floating sections (22Ha, 22Hb, 22Hc, 22Hd, 22He) are established forward of the butt, and one floating section (22Hf) is established backward of the butt.

In (d), seven floating sections (22Ia, 22Ib, 22Ic, 22Id, 22Ie, 22If, 22Ig) are established forward of the butt, with no floating sections in the backward section. In these examples, relatively high floating sections and relatively low floating sections are arranged alternately. For example, in (a), 22Fa, 22Fc and 22Fe form relatively high floating sections, and 22Fb and 22Fd form relatively low floating sections. The most backward float 22Ff is lower than the relatively high floating sections but higher than the relatively low floating sections.

EMBODIMENT 5

Figure 6:
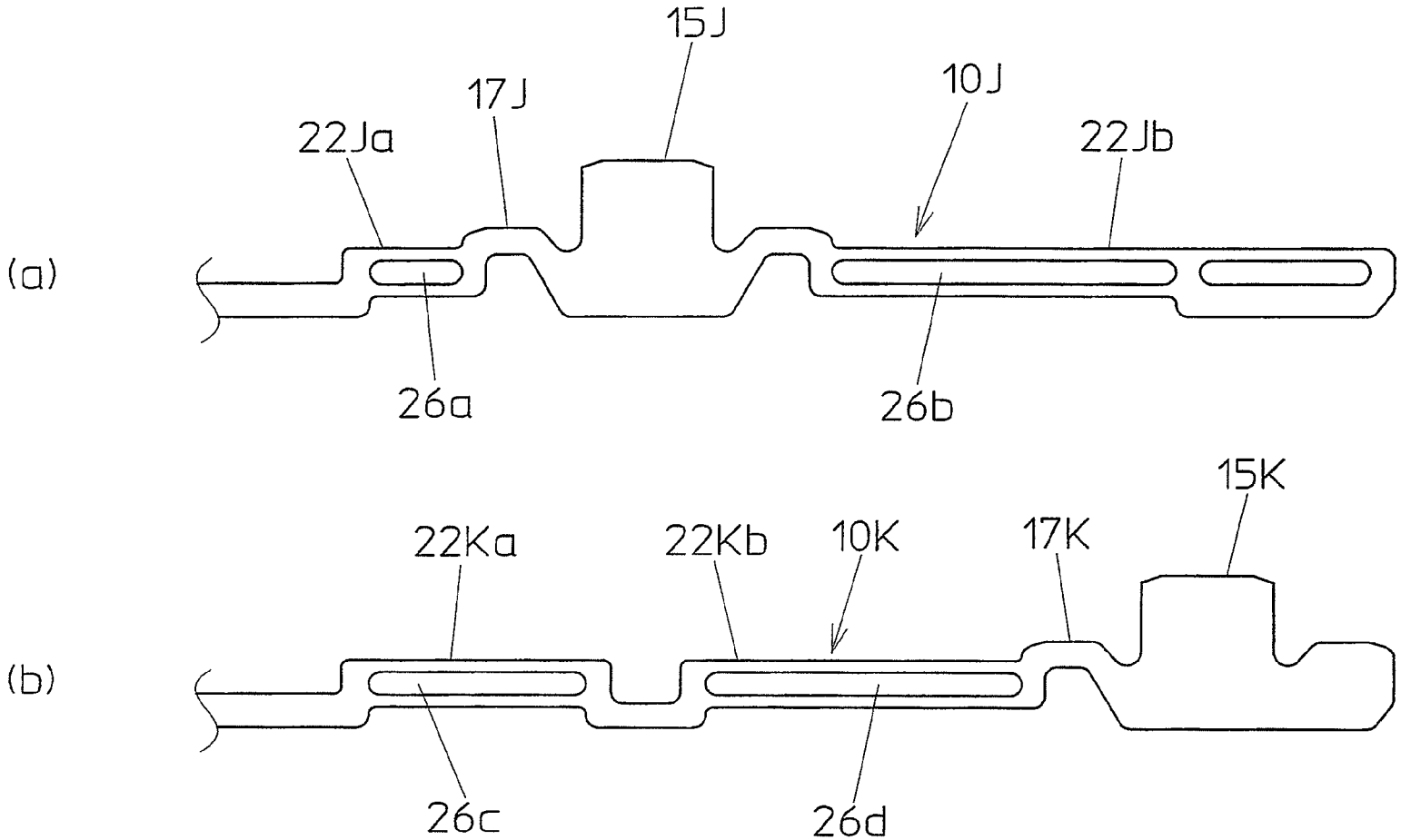
FIGS. 6(*a*), (*b*) are elevations of latch needles 10J and 10K according to the fourth embodiment of the present invention.

FIGS. 6(*a*) and (*b*) are elevations of latch needles 10J and 10K according to the fifth embodiment of the present invention. In this drawing the tips of the needles are omitted. These needles are different from embodiments 1-3 in that in (a), cutouts 26*a* and 26*b* are provided in floating sections 22Ja and 22Jb, and in (b), cutouts 26*c* and 26*d* are provided in floating sections 22Ka and 22Kb. These cutouts contribute to reducing the weight of the latch needles.

EMBODIMENT 6

Figure 7:
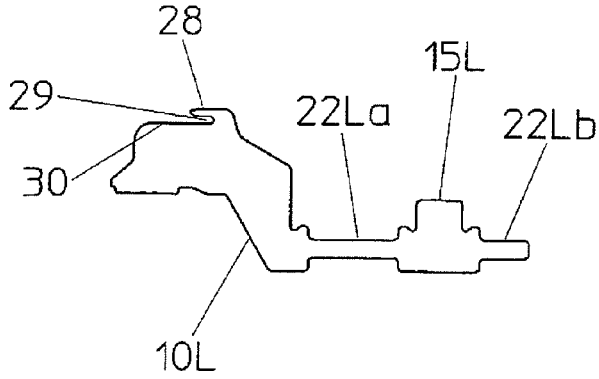
FIG. 7 is an elevation of a sinker 10L according to a fifth embodiment of the present invention.

FIG. 7 shows the sixth embodiment of the present invention. The tool for a circular knitting machine according to this embodiment is a sinker 10L. In addition to the usual sinker elements such as a nose 28, a throat 29 and a sinker top 30, this sinker is further provided with two floating sections (22La, 22Lb), one forward and the other backward of the butt 15L.

In the above explanations, cylinder needles and a sinker are presented as examples of the present invention, but the application of the present invention is not limited to such tools. For example, the present invention can also be applied to a dial needle inserted in a needle dial in a double-knit machine to obtain the same effect.

EXPERIMENT TO CONFIRM THE EFFECT

Figure 8:
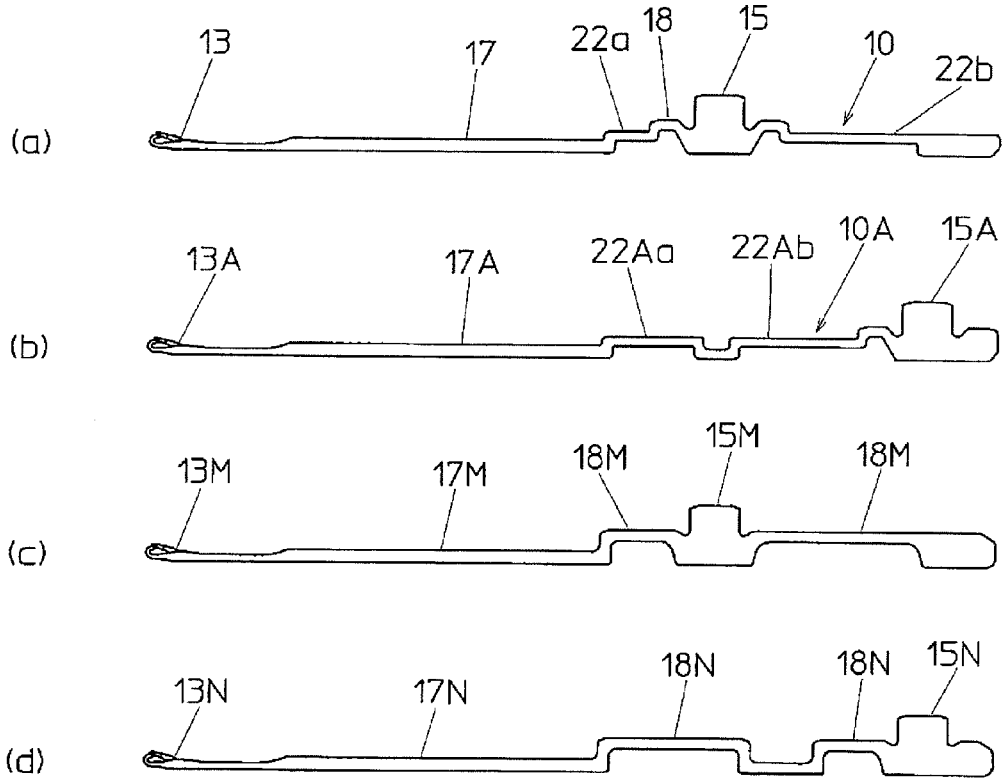
FIG. 8 show a needle of the first embodiment (*a*), a needle of the second embodiment (*b*) and two latch needles according to prior art (*c, d*) used in a comparative experiment.

FIG. 8 shows a needle according to the first embodiment, a needle according to the second embodiment, and two other latch needles used in a test to compare the effect of the present invention with that of prior art. (a) and (b) are latch needles 10 and 10A of the present invention, and (c) and (d) are latch needles according to prior art. In the experiment, the latch needles of the present invention, (a) and (b), were inserted alternately as H butt, L butt, H butt, L butt into the knitting machine. The latch needles of prior art, (c) and (d) were also inserted alternately as H butt, L butt, H butt, L butt into the knitting machine.

As common conditions for these sets of needles, the VXC-3SRE circular knitting machine, 30-inch, 28-gauge, by Precision Fukuhara Works, Ltd., was used. The knitting machine was run continuously for five hours at 50 rpm, and the temperature, electric current and deformation were measured before and after the operation. The results are as shown in Table 1.

TABLE 1

| | Latch needles of prior art | | | Latch needles of the present invention | | |
|---|---|---|---|---|---|---|
| | Before | After | Temperature rise | Before | After | Temperature rise |
| At cam holder periphery | 21.5° C. | 62° C. | 40.5° C. | 21° C. | 54.5° C. | 33.5° C. |
| Cylinder inner surface | 21° C. | 73° C. | 52° C. | 21° C. | 65° C. | 44° C. |
| Driving current just before | | 8.5 amperes | | | 8.0 amperes | |

TABLE 1-continued

| | Latch needles of prior art | | | Latch needles of the present invention | | |
|---|---|---|---|---|---|---|
| | Before | After | Temperature rise | Before | After | Temperature rise |
| stopping the machine | | | | | | |
| Thermal deformation of the cylinder (top and bottom) | | 0.165 mm | | | 0.145 mm | |
| Thermal deformation of the cylinder (front and rear) | | 0.07 mm | | | 0.05 mm | |

It is obvious from this table that the latch needles of the present invention have the effects of suppressing heat generation, saving electricity and preventing deformation.

The tool for a circular knitting machine of the present invention can produce the same effects whether the circular knitting machine is rotating clockwise or counterclockwise.

The invention claimed is:

1. An assembly for a circular knitting machine, the assembly comprising:

a member defining a thin groove, the groove defining a length direction, the groove having a bottom face and an upper end face, a distance L being defined as a depth of the groove from the bottom face to the upper end face in a depth direction perpendicular to the length direction;

a tool inserted into the thin groove and slidable therein along the length direction of the groove, the tool having a stem and at least one butt;

wherein some portions of the stem are spaced above the bottom face of the thin groove in the depth direction and are also spaced below the upper end face of the thin groove in the depth direction, forming floating sections that extend approximately parallel to the length direction of the thin groove in such a way that the floating sections are spaced above the bottom face of the thin groove by a floating length L1 that is 10-40% of the distance L from the bottom face to the upper end face of the thin groove, and are spaced below the upper end face of the thin groove by a sinking length L2 that is 10-40% of L.

2. An assembly for a circular knitting machine according to claim 1 wherein the floating length L1 of the floating sections is 20-30% of L, and the sinking length L2 of the floating sections is 20-30% of L.

3. An assembly for a circular knitting machine according to claim 1 wherein a longitudinal length L4 of the floating sections is 10-60% of the overall length of the tool.

4. An assembly for a circular knitting machine according to claim 1 wherein the floating sections are provided with cutouts.

5. An assembly for a circular knitting machine according to claim 1 wherein a support that reaches the upper end face and bottom end face of the thin groove is established between one floating section and another floating section.

6. An assembly for a circular knitting machine according to claim 1 wherein there are floating sections that extend approximately horizontally and have different heights from one another.

7. An assembly for a circular knitting machine according to claim 1 wherein said tool for a circular knitting machine is a latch needle having a hook and a latch.

8. An assembly for a circular knitting machine according to claim 7 wherein the latch needle is a meander needle having a bridge.

9. An assembly for a circular knitting machine according to claim 1 wherein the tool for a circular knitting machine is a sinker.

10. An assembly for a circular knitting machine according to claim 1 wherein the tool for a circular knitting machine is made by stamping a sheet material.

11. A knitting tool for a circular knitting machine, the knitting tool having a length along a length direction, the knitting tool extending along the length direction from a head to an opposite end, the knitting tool having a thickness along a width direction perpendicular to the length direction, and having a height along a height direction perpendicular to the length and width directions, wherein the knitting tool includes a butt that projects in the height direction, an uppermost surface of the butt defining a maximum height of the knitting tool, the butt being located intermediate the head and the opposite end, portions of the knitting tool defining a lowermost surface of the knitting tool with respect to the height direction;

the knitting tool including at least one stem section disposed between the head and the butt or between the butt and the opposite end, the stem section including a meander section having an upper surface and a lower surface with respect to the height direction, the lower surface of the meander section being spaced above the lowermost surface with respect to the height direction;

the stem section further including floating sections each having an upper surface spaced below the upper surface of the meander section and having a lower surface spaced below the lower surface of the meander section but above the lowermost surface with respect to the height direction.

12. The knitting tool of claim 11, wherein a combined longitudinal length of the floating sections is 10% to 60% of the length of the knitting tool.

13. The knitting tool of claim 11, further comprising one or more supports each having an uppermost surface higher than the upper surface of the floating sections with respect to the height direction, each support having a lowermost surface lower than the lower surface of the floating sections with respect to the height direction.

14. The knitting tool of claim 13, wherein there are a plurality of supports, at least one of the supports being disposed between two of the floating sections with respect to the length direction.

15. The knitting tool of claim 11, wherein the floating sections are longitudinally spaced apart along the knitting tool.

16. The knitting tool of claim 15, wherein some of the floating sections are disposed at a different height from other floating sections, with respect to the height direction.

17. The knitting tool of claim 11, comprising only one stem section, the stem section being disposed between the head and the butt with respect to the length direction.

18. The knitting tool of claim 11, comprising a first stem section disposed between the head and the butt with respect to the length direction, and a second stem section disposed between the butt and the opposite end with respect to the length direction, and wherein each of the first and second stem sections includes at least one said floating section.

19. The knitting tool of claim 18, wherein the first stem section includes only one said floating section and the second stem section includes a plurality of said floating sections longitudinally spaced apart.

20. The knitting tool of claim 18, wherein the first stem section includes a plurality of said floating sections longitudinally spaced apart and the second stem section includes only one said floating section.

* * * * *